US010399351B2

(12) United States Patent
Matsushita

(10) Patent No.: US 10,399,351 B2
(45) Date of Patent: Sep. 3, 2019

(54) CARTRIDGE, LIQUID EJECTING APPARATUS, AND REMAINING LIQUID AMOUNT DETECTION METHOD

(71) Applicant: SEIKO EPSON CORPORATION, Tokyo (JP)

(72) Inventor: Junichiro Matsushita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/665,040

(22) Filed: Jul. 31, 2017

(65) Prior Publication Data

US 2018/0072068 A1 Mar. 15, 2018

(30) Foreign Application Priority Data

Sep. 12, 2016 (JP) ..... 2016-177364

(51) Int. Cl.

*B41J 2/175* (2006.01)
*B41J 2/195* (2006.01)
*B41J 29/38* (2006.01)

(52) U.S. Cl.

CPC ..... *B41J 2/17566* (2013.01); *B41J 2/17503* (2013.01); *B41J 2/17513* (2013.01); *B41J 2/17526* (2013.01); *B41J 2/195* (2013.01); *B41J 29/38* (2013.01); *B41J 2002/17569* (2013.01)

(58) Field of Classification Search

CPC ..... B41J 2/04501; B41J 2/04508; B41J 2/04523; B41J 2/04535; B41J 2/04536; B41J 2/04553; B41J 2/0456; B41J 2/04563; B41J 2/04571; B41J 2/04581; B41J 2/04588; B41J 2/0459; B41J 2/04591; B41J 2/17503; B41J 2/1951

See application file for complete search history.

(56) References Cited

U.S. PATENT DOCUMENTS

2002/0140748 A1 10/2002 Kanaya et al.
2003/0071862 A1* 4/2003 Tsukada ..... B41J 2/17513 347/7
2015/0251468 A1* 9/2015 Sugahara ..... B41J 2/1752 347/37
2016/0243843 A1* 8/2016 Akiyama ..... B41J 2/17543

FOREIGN PATENT DOCUMENTS

JP 2000-218817 8/2000
JP 2004-299342 10/2004

* cited by examiner

*Primary Examiner* — Kristal Feggins
*Assistant Examiner* — Kendrick X Liu
(74) *Attorney, Agent, or Firm* — Workman Nydegger

(57) ABSTRACT

A cartridge holds a liquid to be supplied to a liquid ejecting apparatus. The cartridge includes a storage section configured to store liquid information relating to the liquid held in the cartridge. The cartridge is detachable with respect to the liquid ejecting apparatus. The liquid information includes initial viscosity information relating to an initial viscosity of the liquid in a state prior to the cartridge being mounted to the liquid ejecting apparatus.

8 Claims, 6 Drawing Sheets

| INITIAL VISCOSITY | | |
|---|---|---|
| CYAN (C) | ; | 95% |
| MAGENTA (M) | ; | 99% |
| YELLOW (Y) | ; | 101% |
| BLACK (K) | ; | 108% |

FIG. 9

| | | INITIAL VISCOSITY | | |
|---|---|---|---|---|
| | | HIGH | REFERENCE | LOW |
| DOT SIZE | LARGE | -6% | 0% | 9% |
| | MEDIUM | -4% | 0% | 7% |
| | SMALL | -4% | 0% | 6% |

FIG. 10

| | | INITIAL VISCOSITY | | |
|---|---|---|---|---|
| | | HIGH | REFERENCE | LOW |
| DRIVE FREQUENCY | HIGH | -2% | 4% | 14% |
| | REFERENCE | -4% | 0% | 7% |
| | LOW | -7% | -3% | 2% |

CARTRIDGE, LIQUID EJECTING APPARATUS, AND REMAINING LIQUID AMOUNT DETECTION METHOD

BACKGROUND

1. Technical Field

The present invention relates to a cartridge in which a liquid is held internally, a liquid ejecting apparatus provided with the cartridge, and a remaining liquid amount detection method for the cartridge.

2. Related Art

Liquid ejection apparatuses include image recording apparatuses such as ink jet printers and ink jet plotters. Recently, such liquid ejecting apparatuses are being applied to various manufacturing apparatuses, exploiting the ability to cause tiny amounts of liquid to land accurately at specific positions. For example, application is being made to display manufacturing apparatuses for manufacturing color filters such as liquid crystal displays, electrode forming apparatuses for forming electrodes for organic electroluminescence (EL) displays, field emission displays (FED), and the like, and chip manufacturing apparatuses for manufacturing biochips (biochemical devices). A liquid ejecting head of an image recording apparatus ejects liquid ink, and a liquid ejecting head of a display manufacturing apparatus ejects solutions of respective red (R), green (G), and blue (B) colorants. A liquid ejecting head of an electrode forming apparatus ejects liquid electrode material, and a liquid ejecting head of a chip manufacturing apparatus ejects a solution of bioorganic material.

The liquid supplied to such liquid ejecting heads is held inside cartridges configured so as to be detachable with respect to the liquid ejecting apparatus. Moreover, the liquid is supplied from the cartridges to the liquid ejecting head according to the amount of liquid ejected from the liquid ejecting head, namely, according to a liquid consumption amount. Moreover, liquid ejecting apparatuses are being developed that, for example, predict a remaining liquid amount inside a cartridge and give a notification prompting a user to replace the cartridge when the remaining liquid amount has fallen below a specific value. One method for predicting the remaining liquid amount inside a cartridge is to compute a consumption amount by multiplying the weight of an ejected liquid droplet by the number of liquid droplets ejected, and then computing a remaining liquid amount based on the consumption amount. In addition, JP-A-2004-299342 describes a method to detect the viscosity of liquid inside a liquid ejecting head and to compute a remaining liquid amount inside a cartridge using a table expressing relationships between liquid droplet consumption amounts and liquid droplet viscosity.

Note that in methods such as those described above, it is necessary to provide a way of detecting the viscosity, such as a sensor, to detect the viscosity of the liquid inside the liquid ejecting head. This gives rise to not only an increase in the complexity of the liquid ejecting apparatus, but also an increase in the size of the liquid ejecting apparatus. Moreover, in cases in which manufacturing variation or the like results in variation in the initial viscosity of the liquid held in a cartridge, the relationship between the liquid droplet consumption amount and liquid droplet viscosity shifts; thus, the remaining liquid amount inside the cartridge cannot be accurately computed.

SUMMARY

An advantage of some aspects of the invention is to provide a cartridge, a liquid ejecting apparatus, and a remaining liquid amount detection method capable of computing a remaining liquid amount more accurately and with a simple configuration.

A first aspect of the invention is a cartridge holding a liquid to be supplied to a liquid ejecting apparatus. The cartridge includes a storage section configured to store liquid information relating to the liquid held in the cartridge. The cartridge is detachable with respect to the liquid ejecting apparatus. The liquid information includes initial viscosity information relating to an initial viscosity of the liquid in a state prior to the cartridge being mounted to the liquid ejecting apparatus.

According to this configuration, even if variation arises in the initial viscosity of the liquid held in the cartridge due to manufacturing variation or the like, the initial viscosity information of the liquid inside the cartridge can be read, enabling the liquid consumption amount to be corrected based on the initial viscosity information. This thereby enables a more accurate liquid consumption amount to be obtained, thus enabling more accurate computation of the remaining liquid amount.

A second aspect of the invention is a liquid ejecting apparatus including a cartridge, a liquid ejecting head, and a control circuit. The cartridge is the cartridge according to the above configuration. The liquid ejecting head includes a pressure chamber to which the liquid is supplied and includes a nozzle in communication with the pressure chamber. The liquid ejecting head is configured to eject the liquid from the nozzle toward a landing target. The control circuit is configured to control ejection of the liquid by the liquid ejecting head based on image information for an image to be formed on the landing target. The control circuit is configured to correct a unit ejection amount corresponding to a single droplet of liquid ejected from the nozzle in a case in which a viscosity of the liquid is a predetermined reference viscosity, the correction being based on the initial viscosity information acquired from the storage section, compute a consumption amount of liquid that has been ejected from the nozzle based on the corrected unit ejection amount and the image information, and predict a remaining liquid amount inside the cartridge based on the consumption amount.

This configuration enables more accurate computation of the remaining liquid amount. Moreover, since there is no need to provide a way of detecting the viscosity, such as a sensor, the liquid ejecting apparatus has a simple configuration.

In the above configuration, configuration may preferably be made wherein a correction amount for the unit ejection amount in cases in which the initial viscosity information is information indicating a lower viscosity than the reference viscosity is greater than a correction amount for the unit ejection amount in cases in which the initial viscosity information is information indicating a higher viscosity than the reference viscosity.

This configuration enables even more accurate computation of the remaining liquid amount.

In any of the above configurations, configuration may preferably be made wherein the image information includes information relating to the size of a dot to be formed on the landing target, and the unit ejection amount is corrected based on the information relating to the size of the dot.

This configuration enables even more accurate computation of the remaining liquid amount.

In any of the above configurations, configuration may preferably be made wherein the liquid ejecting apparatus operates in a high frequency mode in which an ejection frequency of liquid ejected from the nozzle is relatively high and a low frequency mode in which an ejection frequency of liquid ejected from the nozzle is relatively low, and a correction amount for the unit ejection amount in cases in which the high frequency mode has been selected is greater than a correction amount for the unit ejection amount in cases in which the low frequency mode has been selected.

This configuration enables even more accurate computation of the remaining liquid amount, even in cases in which the ejection frequency of the liquid changes.

In any of the above configurations, configuration may preferably be made wherein the liquid ejecting apparatus includes plural of the cartridges according to the above configuration, and a different type of liquid is held inside each of the cartridges. Moreover, for each of the cartridges, the control circuit is configured to correct a unit ejection amount corresponding to a single droplet of liquid ejected from the nozzle in a case in which a viscosity of the liquid is a predetermined reference viscosity, the correction being based on the initial viscosity information acquired from the storage section, compute a consumption amount of liquid that has been ejected from the nozzle based on the corrected unit ejection amount and the image information, and predict a remaining liquid amount inside the cartridge based on the consumption amount.

This configuration enables more accurate computation of the remaining liquid amount for each of the cartridges.

In any of the above configurations, configuration may preferably be made wherein the liquid ejecting apparatus includes plural cartridges, a different type of liquid being held inside each of the cartridges, and the cartridge according to the above configuration is employed for at least a black cartridge holding a black liquid from out of the plural cartridges. Moreover, the control circuit is configured to correct a unit ejection amount corresponding to a single droplet of black liquid ejected from the nozzle in communication with the black cartridge in a case in which a viscosity of the black liquid held in the black cartridge is a predetermined reference viscosity, the correction being based on the initial viscosity information for the liquid inside the black cartridge acquired from the storage section, compute a consumption amount of black liquid that has been ejected from the nozzle based on the corrected unit ejection amount and the image information, and predict a remaining liquid amount inside the black cartridge based on the consumption amount.

This configuration enables more accurate computation of the remaining liquid amount for at least the black cartridge.

In any of the above configurations, configuration may preferably be made wherein the liquid ejecting apparatus includes plural cartridges, and the cartridge according to the above configuration is employed for at least a high capacity cartridge having the largest capacity of a liquid holding section from out of the plural cartridges. Moreover, the control circuit is configured to correct a unit ejection amount corresponding to a single droplet of liquid ejected from the nozzle in communication with the high capacity cartridge in a case in which a viscosity of the liquid held in the high capacity cartridge is a predetermined reference viscosity, the correction being based on the initial viscosity information for the liquid inside the high capacity cartridge acquired from the storage section, compute a consumption amount of the liquid that has been ejected from the nozzle based on the corrected unit ejection amount and the image information, and predict a remaining liquid amount inside the high capacity cartridge based on the consumption amount.

This configuration enables more accurate computation of the remaining liquid amount for at least the high capacity cartridge.

A third aspect of the invention is a liquid ejecting apparatus including the cartridge according to the above configuration, and a display device that displays the initial viscosity information.

This configuration enables a user to ascertain the initial viscosity information of the liquid inside the cartridge.

A fourth aspect of the invention is a remaining liquid amount detection method for a cartridge of a liquid ejecting apparatus, the liquid ejecting apparatus including the cartridge, a liquid ejecting head, and a control circuit. The cartridge includes a storage section configured to store liquid information relating to a liquid held in the cartridge. The liquid ejecting head includes a pressure chamber to which the liquid is supplied and includes a nozzle in communication with the pressure chamber, and the liquid ejecting head is configured to eject the liquid from the nozzle toward a landing target. The control circuit is configured to control ejection of the liquid by the liquid ejecting head based on image information for an image to be formed on the landing target. The remaining liquid amount detection method includes correcting a unit ejection amount corresponding to a single droplet of liquid ejected from the nozzle in a case in which a viscosity of the liquid is a predetermined reference viscosity, the correction being based on initial viscosity information acquired from the storage section, the initial viscosity information being included in the liquid information and relating to an initial viscosity of the liquid in a state prior to the cartridge being mounted to the liquid ejecting apparatus. The remaining liquid amount detection method further includes computing a consumption amount of liquid that has been ejected from the nozzle based on the corrected unit ejection amount and the image information, and predicting a remaining liquid amount inside the cartridge based on the consumption amount.

This method enables more accurate computation of the remaining liquid amount.

BRIEF DESCRIPTION OF THE DRAWINGS

The invention will be described with reference to the accompanying drawings, wherein like numbers reference like elements.

FIG. 9 is a diagram to explain an example of a correction coefficient table.

FIG. 10 is a diagram to explain another example of a correction coefficient table.

DESCRIPTION OF EXEMPLARY EMBODIMENTS

Explanation follows regarding an embodiment of the invention, with reference to the accompanying drawings. Note that in the embodiment described below, although various limitations are given with respect to particularly suitable specific examples of the invention, the scope of the invention is not limited thereby unless specifically indicated to be so in the following explanation. Moreover, in the following, an ink jet recording apparatus (a "printer" hereafter) is explained as an example of a liquid ejecting apparatus of the invention.

Figure 1:
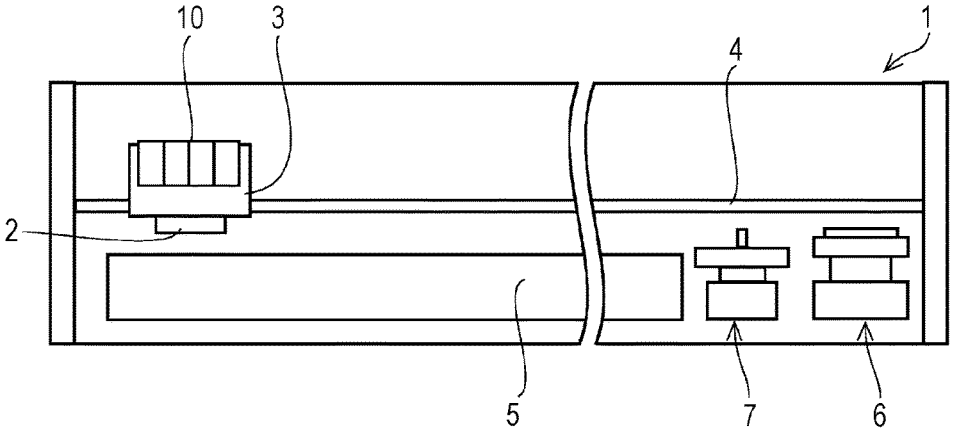
FIG. 1 is a schematic diagram to explain an internal configuration of a printer.
Figure 2:
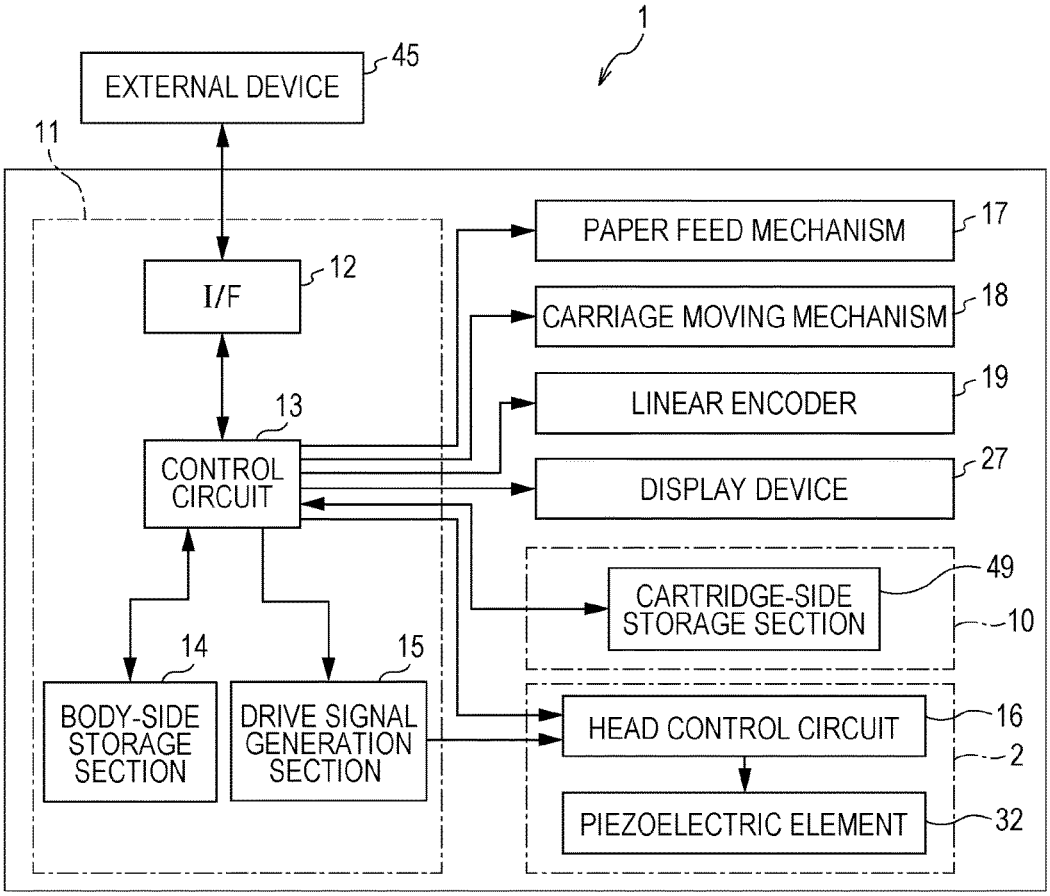
FIG. 2 is a block diagram to explain an electrical configuration of a printer.

FIG. 1 is a front view to explain an internal configuration of a printer 1. FIG. 2 is a block diagram to explain an electrical configuration of the printer 1. A recording head 2, this being a type of liquid ejecting head, is attached to a bottom face side of a carriage 3 to which ink cartridges 10 (one type of a cartridge of the invention) are installed. The ink cartridges 10 are detachably mounted to the carriage 3. Moreover, the carriage 3 is configured capable of moving to-and-fro along a guide rod 4, driven by a carriage moving mechanism 18. Namely, in the printer 1, driven by a paper feed mechanism 17, recording medium (one type of a landing target of the invention) is sequentially transported over a platen 5, and ink (one type of a liquid of the invention) is ejected from nozzles 35 (see FIG. 4) of the recording head 2 while the recording head 2 is moved relative to the recording medium in a width direction (main scanning direction) of the recording medium, thereby recording an image or the like by causing the ink to land on the recording medium. Note that configuration may be adopted in which the ink cartridges are disposed on a body side of the printer, and ink from the ink cartridges is transported to a recording head 2 side of the printer through supply tubing.

Inside the printer 1, a home position, this being a standby position of the recording head 2, is set at a position separated from the platen 5 on one main scanning direction side of the printer 1 (on the right side in FIG. 1). At the home position, a capping mechanism 6 and a wiping mechanism 7 are provided in this sequence from the one end side. The capping mechanism 6 is, for example, a mechanism provided with a cap or the like to close off a nozzle face 34 (see FIG. 4) of the recording head 2 when in a standby state. The wiping mechanism 7 is a mechanism provided with a wiper or the like to wipe the nozzle face 34 during a maintenance operation.

Next, explanation follows regarding the electrical configuration of the printer 1. As illustrated in FIG. 2, respective sections of the printer 1 of the present embodiment are controlled by a printer controller 11. The printer controller 11 of the present embodiment includes an interface (I/F) section 12, a control circuit 13, a body-side storage section 14, and a drive signal generation section 15. The interface section 12 receives print data and print commands from an external device 45 such as a computer or a mobile information terminal, and outputs status information of the printer 1 to the external device 45 side. The body-side storage section 14 is a device that stores a program for a control circuit 13 and data employed in various types of control, and includes ROM, RAM, a non-volatile storage device (NVRAM), and the like.

The control circuit 13 controls each unit according to the program stored in the body-side storage section 14. Moreover, in the present embodiment, the control circuit 13 generates ejection data indicating at what timing ink is to be ejected from which nozzle 35 of the recording head 2 during a recording operation, based on print data including, for example, image information for an image to be formed on the recording medium, sent from the external device 45. This ejection data is transmitted to a head control circuit 16 of the recording head 2. Moreover, a timing pulse PTS is generated using an encoder pulse output from a linear encoder 19. The control circuit 13 is synchronized with the timing pulse PTS, and also controls the forwarding of print data, the generation of drive signals by the drive signal generation section 15, and the like. The control circuit 13 generates timing signals such as latch signals LAT based on the timing pulse PTS, and outputs these timing signals to the head control circuit 16 of the recording head 2. The head control circuit 16 selectively applies a drive pulse contained in the drive signals to piezoelectric elements 32 (see FIG. 4) based on the ejection data and the timing signals described above. The piezoelectric elements 32 are thereby driven so as to eject (discharge) ink droplets from the nozzles 35, or alternatively, so as to perform a micro-vibration operation at a level that does not eject ink droplets. The drive signal generation section 15 generates drive signals including a drive pulse in order to eject ink droplets onto the recording medium and record an image or the like.

The control circuit 13 also functions as an ink consumption amount computation unit (discharge counter), and computes an ink consumption amount for the ink cartridges 10 of each color, in accordance with the ejection (discharge) of ink droplets from the recording head 2. Namely, for each ink cartridge 10, the control circuit 13 counts the number of times ink droplets are ejected (the number of times drive pulses have been supplied to the piezoelectric elements 32) based on the image information, and computes the amount of ink consumed (referred to hereafter as the ink consumption amount) for each color of ink by multiplying the discharge count value by an ink droplet discharge amount (weight) that is ejected in a single ejection operation. Note that a feature of the printer 1 of the present embodiment is that the printer 1 corrects a design-reference ink droplet discharge amount ejected in a single ejection operation (referred to hereafter as the unit ejection amount) based on initial viscosity information stored in a cartridge-side storage section 49 in each ink cartridge 10. This point will be described in detail later. The ink consumption amount is stored in the body-side storage section 14. When the ink consumption amount has exceeded a predetermined threshold value, namely, when the remaining ink amount of an ink cartridge 10 has become low, the control circuit 13 for example uses a display device 27 to notify a user that the remaining ink amount in the ink cartridge 10 is running low. The ink consumption amount information computed by the control circuit 13 is also output to the external device 45 using the I/F section 12. A display section of the external device 45, for example, performs display relating to the ink level in each of the ink cartridges 10 based on the ink consumption amount received from the printer 1 side. This enables a user to ascertain replacement timings of the ink cartridges 10 with ease.

As illustrated in FIG. 2, the printer 1 of the present embodiment includes the paper feed mechanism 17, the carriage moving mechanism 18, the linear encoder 19, the display device 27, the ink cartridges 10, the recording head 2, and the like. The carriage moving mechanism 18 is configured including the carriage 3 to which the recording head 2 is attached, and a drive motor (for example, a DC motor) that drives the carriage 3 using a timing belt or the like (these elements are not illustrated in the drawings). The carriage moving mechanism 18 moves the recording head 2 installed to the carriage 3 along the main scanning direction. The paper feed mechanism 17 is configured including a paper feed motor, paper feed rollers, and the like (none of which are illustrated in the drawings). The paper feed mechanism 17 sequentially feeds the recording medium onto the platen 5 and moves the recording medium over the platen 5 in a sub scanning direction. The linear encoder 19 outputs an encoder pulse corresponding to the scan position of the recording head 2 installed to the carriage 3 to the printer controller 11 as main scanning direction position information. The control circuit 13 of the printer controller 11 is capable of ascertaining a scan position (current position) of the recording head 2 based on the encoder pulse received from the linear encoder 19 side.

Figure 3:
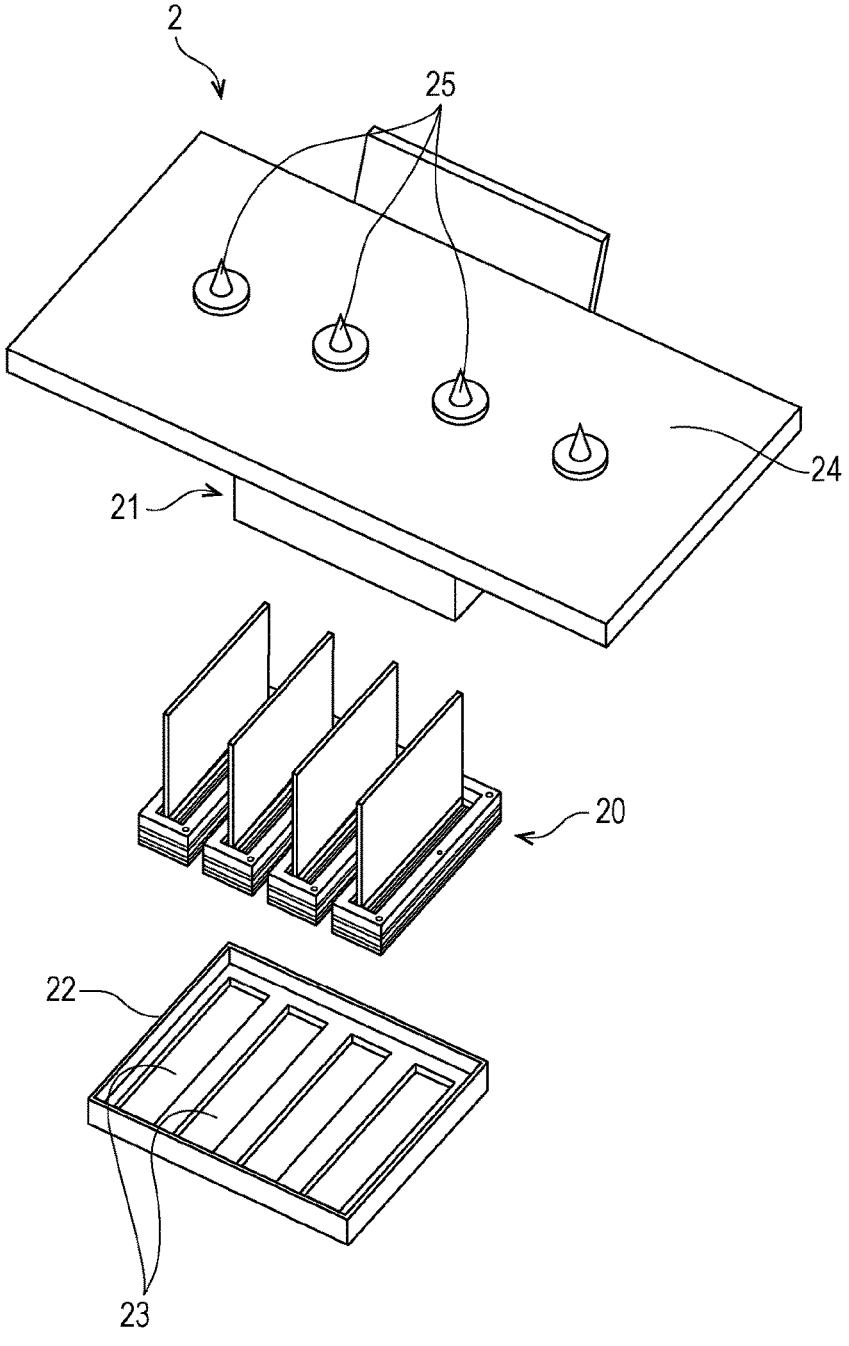
FIG. 3 is an exploded perspective view to explain a configuration of a recording head.
Figure 4:
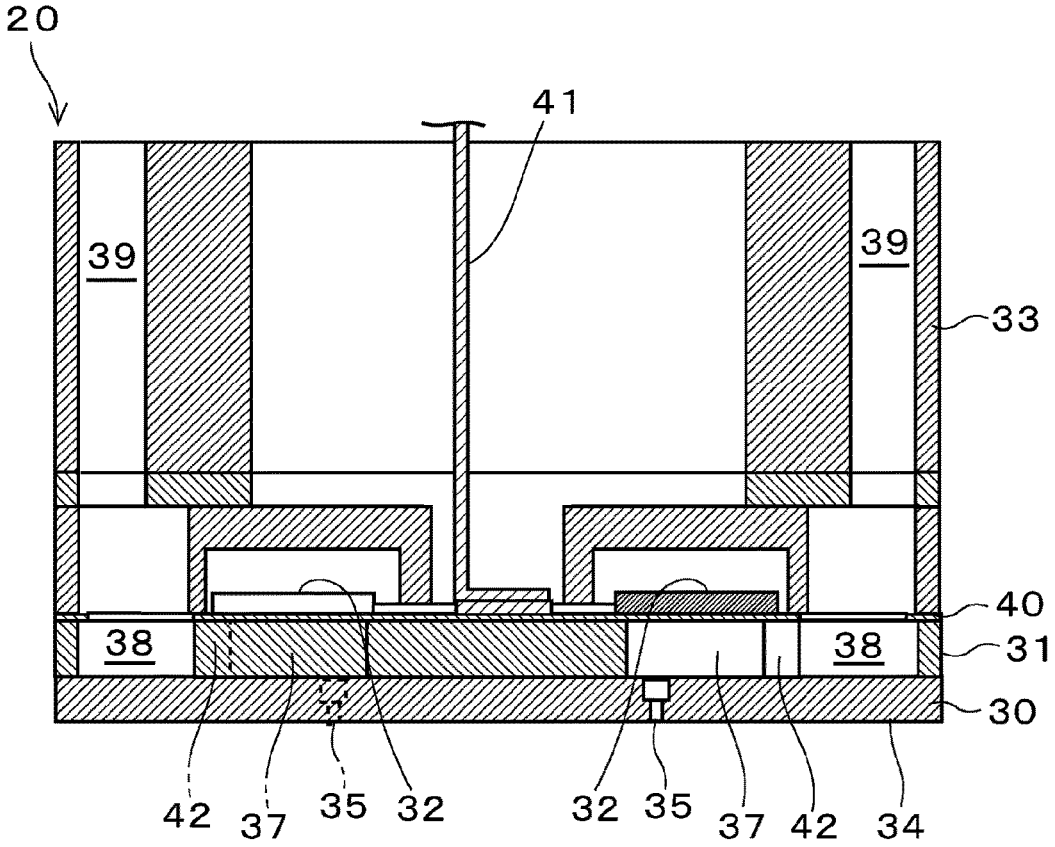
FIG. 4 is a cross-section to explain configuration of a head unit.

Next, explanation follows regarding configuration of the recording head 2. FIG. 3 is an exploded perspective view to explain configuration of the recording head 2 of the present embodiment. FIG. 4 is a cross-section to explain configuration of a head unit 20. The recording head 2 of the present embodiment includes a holder 21, plural of the head units 20, and a fixing plate 22. The holder 21 is a box shaped member housing the head units 20 and supply paths (not illustrated in the drawings) that supply ink to the head units 20. An ink inlet unit 24 is formed at an upper face side of the holder 21. In the present embodiment, the ink inlet unit 24 is mounted with respective ink cartridges 10 for a total of four colors (for example cyan (C), magenta (M), yellow (Y), and black (K)). Accordingly, an upper face of the ink inlet unit 24 is provided with a total of four ink inlet needles 25 corresponding to the four colored ink cartridges 10. The ink inlet needles 25 are hollow, needle-shaped members connected to ink supply ports 48 (see FIG. 5) of the respective ink cartridges 10. Ink inside the ink cartridges 10 is introduced to the supply paths in the holder 21 through the ink inlet needles 25, and is supplied to the side of the respective head units 20 via the supply paths. Note that configuration is not limited to that in which the ink inlet needles 25 are inserted into the ink cartridges 10, and configuration may be made in which ink is exchanged by contacting a porous member provided to a flow path entry port on the ink inlet unit side against a porous member provided to an ink supply port (ink outlet) on the ink cartridge side.

Plural of the head units 20 are attached to a bottom face side of the holder 21. In the present embodiment, four of the head units 20, corresponding to the four colored ink cartridges 10, are provided side-by-side along the main scanning direction in a state with their length directions aligned with a direction orthogonal to the main scanning direction. Each head unit 20 is adhered and fixed to the fixing plate 22 in a state in which the head units 20 are positioned with respect to one another. The fixing plate 22 is a metal plate member formed from stainless steel (SUS) or the like, and protects lower faces and side faces of the head units 20. The fixing plate 22 is formed with four openings 23 corresponding to the respective head units 20 so as to expose nozzle plates 30 (namely, the nozzle faces 34) of the respective head units 20. Accordingly, the nozzles 35 of each of the head units 20 fixed to the holder 21 are exposed through the respective openings 23. Note that the number of head units 20 attached to the recording head 2 is not limited to four; it is sufficient that at least one head unit 20 be provided.

As illustrated in FIG. 4, the head units 20 of the present embodiment each include a nozzle plate 30, a flow path substrate 31, piezoelectric elements 32, a head case 33, and the like. These members are configured in a layered state. The nozzle plate 30 is a plate shaped member in which plural of the nozzles 35 are laid out linearly at a specific pitch along the sub scanning direction. The nozzle plate 30 is, for example, configured by a silicon substrate or a metal plate member. As illustrated in FIG. 4, the nozzle plate 30 of the present embodiment is provided with two nozzle rows (nozzle sets), each configured by plural of the nozzles 35, running alongside each other in two lines in the main scanning direction. The nozzle face 34 is configured by a face of the nozzle plate 30 on the side to which ink is discharged from the nozzles 35. Namely, plural of the nozzles 35 are opened in the nozzle face 34.

The flow path substrate 31 is formed with plural pressure chambers 37, corresponding to the respective nozzles 35, partitioned from one another by plural dividing walls. A common liquid chamber 38 is formed at an outer side of each row of the pressure chambers 37 in the flow path substrate 31 in order to supply ink to the respective pressure chambers 37. The common liquid chambers 38 are in communication with the respective pressure chambers 37 through ink supply ports 42 having a smaller flow path area than the common liquid chambers 38. Ink inlet paths 39, formed in the head case 33 on the opposite side of the respective common liquid chambers 38 to the nozzle plate 30, are in communication with the respective common liquid chambers 38. Ink from the ink cartridge 10 side is thus introduced to the common liquid chambers 38 through the respective ink inlet paths 39 in the head case 33.

Moreover, the piezoelectric elements 32 (one type of an actuator) are formed on an upper face of the flow path substrate 31, on the opposite side to the nozzle plate 30 side of the flow path substrate 31. An elastic diaphragm 40 is interposed between the piezoelectric elements 32 and the flow path substrate 31. Each piezoelectric element 32 is, for example, configured by a lower electrode film made of metal, a piezoelectric body layer configured from lead zirconate titanate, and a upper electrode film made of metal (none of which are illustrated in the drawings), layered in sequence. The piezoelectric elements 32 are what are referred to as flexural mode piezoelectric elements, and are formed so as to cover upper portions of the respective pressure chambers 37. In each of the head units 20 of the present embodiment, two rows of the piezoelectric elements are disposed alongside each other, corresponding to the two nozzle rows. The two rows of the piezoelectric elements are disposed such that the piezoelectric elements 32 are in a state mutually offset with respect to one another as viewed along the nozzle row direction. Each piezoelectric element 32 undergoes deformation as a result of being applied with drive signals from the printer controller 11 via a wiring member 41, for example a flexible cable. This causes pressure fluctuations on the ink inside the pressure chambers 37 corresponding to the respective piezoelectric elements 32. The pressure fluctuations on the ink are controlled so as to eject ink toward the recording medium from the nozzles 35 in communication with the respective pressure chambers 37.

Figures 5, 6:
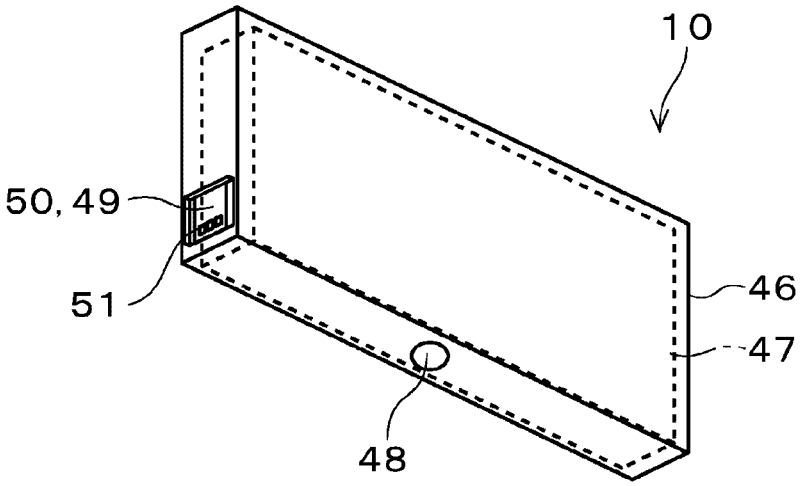
FIG. 5 is a perspective view to explain configuration of an ink cartridge.
FIG. 6 is a diagram illustrating an example of a screen displaying an initial viscosity.

Next, explanation follows regarding the ink cartridges 10 that supply ink to the recording head 2 described above. FIG. 5 is a perspective view schematically illustrating configuration of an ink cartridge 10. The ink cartridge 10 includes a case 46, an ink chamber 47, in which ink is held, formed inside the case 46, a circuit substrate 50 including the cartridge-side storage section 49, and the like. The case 46 is a box shaped member configured from a resin or the like. A lower end face (face on the recording head 2 side) of the case 46 is formed with the ink supply port 48. The ink supply port 48 is a portion that connects with the ink inlet needle 25, and that is in communication with the ink chamber 47. Accordingly, when the ink inlet needle 25 is inserted into the ink cartridge 10, ink held inside the ink chamber 47 is supplied to the recording head 2 side through the ink inlet needle 25. Note that in an initial state (a state before mounting to the printer 1), a film, not illustrated in the drawings, seals off the opening of the ink supply port 48. This thereby prevents ink from leaking from the ink supply port 48. This also suppresses an increase in the viscosity of the ink inside the ink chamber 47. When the ink cartridge 10 is mounted in the printer 1, the film on the ink supply port 48 is pierced by the ink inlet needle 25 and the ink inlet needle 25 is inserted into the ink chamber 47.

The circuit substrate 50 includes a connection terminal 51 that is connected to a non-illustrated terminal on the carriage 3 side. The circuit substrate 50 is attached to the case 46 in a state exposing the connection terminal 51. Namely, the connection terminal 51 is connected to the terminal on the carriage 3 side by mounting the ink cartridge 10 to the printer 1. The control circuit 13 of the printer 1 and the circuit substrate 50 are thereby electrically connected together. The cartridge-side storage section 49 provided to the circuit substrate 50 is stored with ink information (one type of liquid information of the invention) relating to the ink held in the ink chamber 47. For example, the ink color, the ink filling date, an identification number of the ink cartridge 10, and the like, are stored in the cartridge-side storage section 49 as the ink information. Initial viscosity information, relating to an initial viscosity of the ink in an initial state prior to mounting the ink cartridge 10 in the printer 1 (namely, a viscosity of the ink measured at a reference temperature at the time of manufacture of the ink cartridge 10), is also stored in the cartridge-side storage section 49 as the ink information. Note that the initial viscosity information may, for example, be an initial viscosity value of the ink taken as-is, or may be an index indicating whether the viscosity is higher or lower than a predetermined reference viscosity (a proportion with respect to a predetermined reference viscosity (design value)). In addition, information may be stored to indicate that the initial viscosity is "reference" in cases in which the initial viscosity is within a particular range (for example within ±2% of a reference viscosity), this being a tolerance range, that the initial viscosity is "high" in cases in which the viscosity is higher than the tolerance range, or that the initial viscosity is "low" in cases in which the viscosity is lower than the tolerance range.

Such initial viscosity information is transmitted to the control circuit 13 and is referred to when computing the ink consumption amount. The initial viscosity information is also output to the display device 27 or the display section of the external device 45. For example, FIG. 6 is a diagram illustrating an example of a screen displaying initial viscosities. In the example of FIG. 6, the initial viscosity corresponding to cyan (C) ink is 95% of the reference viscosity, the initial viscosity corresponding to magenta (M) ink is 99% of the reference viscosity, the initial viscosity corresponding to yellow (Y) ink is 101% of the reference viscosity, and the initial viscosity corresponding to black (K) ink is 108% of the reference viscosity. Namely, the initial viscosity information is displayed for each cartridge installed in the printer 1. Note that the value of the initial ink viscosity as-is, or, for example, indicators such as "high" and "low", may be displayed as the initial viscosity information. For example, "reference" may be displayed for the initial viscosity corresponding to the magenta (M) ink and the initial viscosity corresponding to the yellow (Y) ink, since the initial viscosities of these inks are within the tolerance range. "Low" may be displayed for the initial viscosity corresponding to the cyan (C) ink since this viscosity is lower than the tolerance range, and "high" may be displayed for the initial viscosity corresponding to the black (K) ink since this viscosity is higher than the tolerance range. Instead of displaying the initial viscosity information alone, the remaining ink amount or the like of each color may also be displayed in combination therewith on the same screen. This enables a user to ascertain the initial viscosity information and the like for the ink inside each of the ink cartridges 10.

Next, explanation follows regarding a remaining ink amount detection method performed by the control circuit 13 for the ink inside the ink cartridges 10. First, the control circuit 13 acquires, from the body-side storage section 14, the unit ejection amount (also referred to as the ink droplet discharge amount) ejected from a nozzle 35 in a single ejection operation in a case in which the ink viscosity is the predetermined reference viscosity. Namely, the unit ejection amount corresponding to a single ink droplet ejected from the nozzle 35 is acquired. Note that changing a drive frequency results in a change in the unit ejection amount (ink droplet discharge amount) (see the graph in FIG. 7) due to, for example, the influence of residual vibration of a meniscus inside the nozzle 35. Accordingly, in the present embodiment, the body-side storage section 14 is, for example, pre-stored with a table of unit ejection amounts for ink at the reference viscosity, corresponding to drive frequency modes that are employed. The unit ejection amount is acquired from the body-side storage section 14 according to a determined drive frequency mode.

More specifically, information relating to the size of dots to be formed on the recording medium is acquired from the image information for the image to be formed on the recording medium. This is used to determine the drive frequency (namely, the ejection frequency at which ink is ejected from the nozzles 35). For example, a mode in which ink droplet ejection from a nozzle 35 is performed once in order to form a small dot on the recording medium has a comparatively low drive frequency. A mode in which ink droplet ejection from a nozzle 35 is performed twice in order to form a medium-sized dot on the recording medium has a higher drive frequency than the small dot formation mode. A mode in which ink droplet ejection from a nozzle 35 is performed four times in order to form a large dot on the recording medium has an even higher drive frequency than the medium-sized dot formation mode. Namely, the mode that forms a large dot corresponds to a high frequency mode in which the drive frequency is relatively high, the mode that forms a small dot corresponds to a low frequency mode in which the drive frequency is relatively low, and the mode that forms a medium-sized dot corresponds to a reference mode having an intermediate drive frequency. In short, in the present embodiment, unit ejection amounts for the ink at the reference viscosity are stored in the body-side storage section 14 respectively for the large dot formation mode, the medium-sized dot formation mode, and the small dot formation mode. The unit ejection amount is acquired from the body-side storage section 14 according to the size of a dot to be formed. Note that unit ejection amount correction values corresponding to the drive frequency modes (or dot sizes) may be stored in the body-side storage section 14, and unit ejection amounts corresponding to the drive frequency (or dot size to be formed) may be derived by correcting a predetermined unit ejection amount for a reference drive frequency and reference viscosity based on the correction values.

Figure 7:
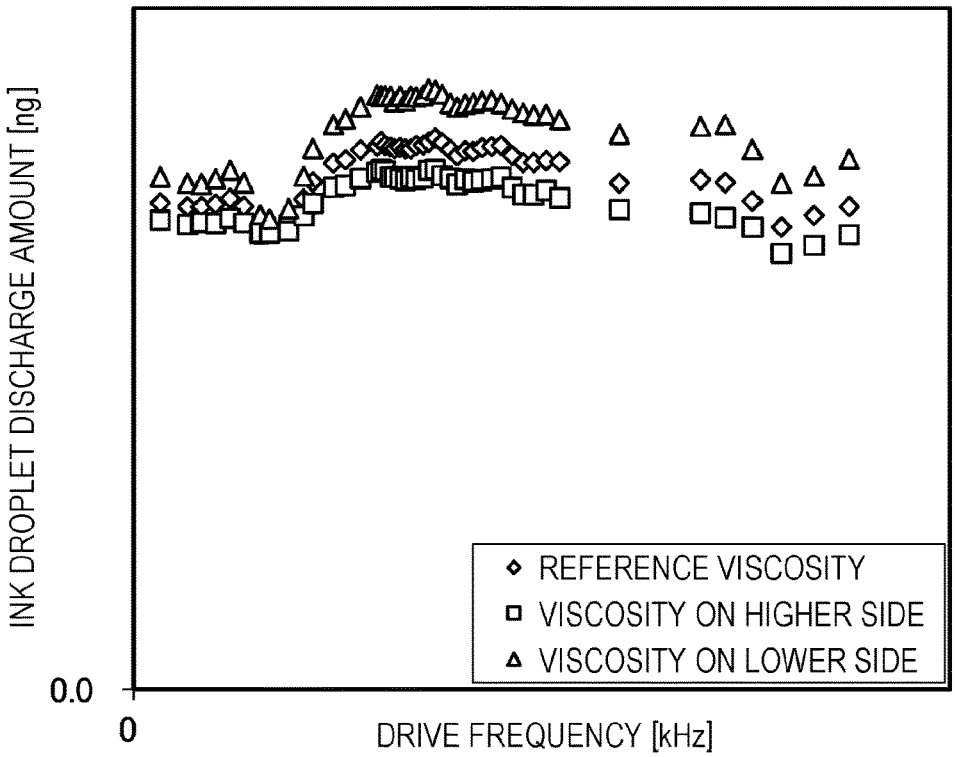
FIG. 7 is a graph illustrating change in an ink droplet discharge amount when drive frequency is changed.
Figure 8:
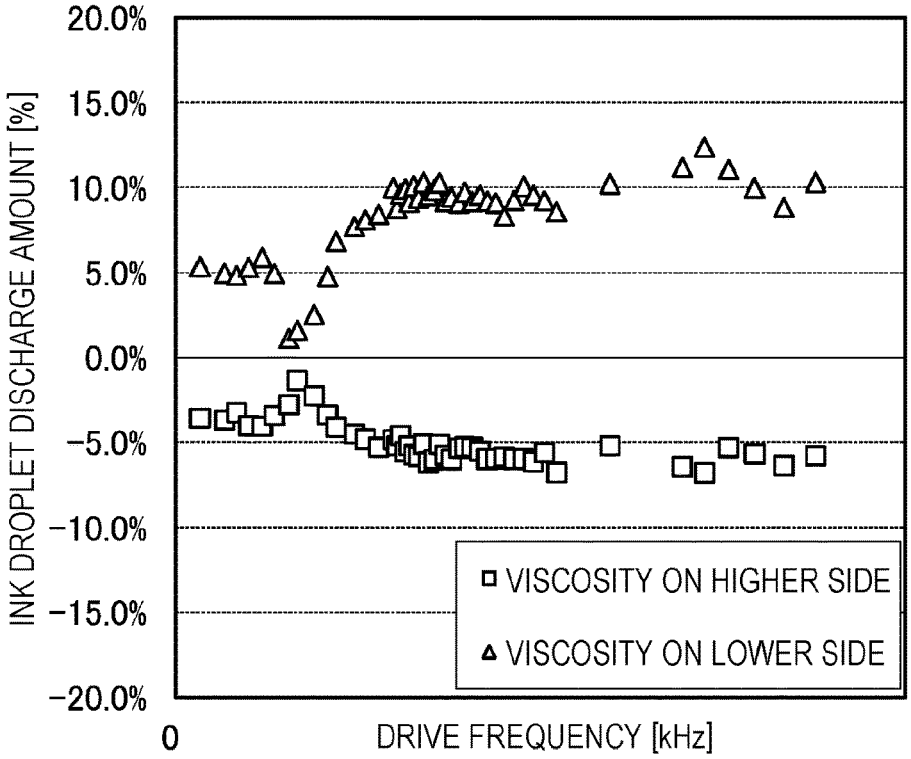
FIG. 8 is a graph illustrating change in an ink droplet discharge amount when drive frequency is changed.

Note that the unit ejection amount also changes as a result of changes to the ink viscosity. Explanation follows regarding this point, with reference to the graphs illustrated in FIG. 7 and FIG. 8 that illustrate relationships between drive frequency and ink droplet discharge amounts (namely, the unit ejection amount). The horizontal axis in the graphs of FIG. 7 and FIG. 8 indicates drive frequency. The vertical axis in the graph of FIG. 7 indicates absolute ink droplet discharge amount. The vertical axis in the graph of FIG. 8 indicates relative ink droplet discharge amount, and more specifically, indicates an amount of divergence (%) from the ink droplet discharge amount at the reference viscosity. Namely, FIG. 8 is a graph representing the percentage by which the ink droplet discharge amount diverges from the ink droplet discharge amount at the reference viscosity, for ink having a higher viscosity than the reference viscosity (viscosity on the higher side) and for ink having a lower viscosity than the reference viscosity (viscosity on the lower side). The graph in FIG. 7 plots relationships between drive frequency and ink droplet discharge amount for three inks: ink at the reference viscosity; ink having a higher viscosity than the reference viscosity (viscosity on a higher side); and ink having a lower viscosity than the reference viscosity (viscosity on a lower side). Note that FIG. 7 and FIG. 8 illustrate substantially the same amount of divergence from the reference viscosity for ink viscosity on the higher viscosity side and ink viscosity on the lower viscosity side. In other words, absolute values of the difference between ink viscosity on the higher viscosity side and the reference viscosity are substantially the same as absolute values of the difference between ink viscosity on the lower viscosity side and the reference viscosity.

As illustrated in the graph of FIG. 7, a trend can be discerned whereby the ink droplet discharge amount increases in ascending order through: higher viscosity than the reference viscosity (viscosity on the higher side); the reference viscosity; and lower viscosity than the reference viscosity (viscosity on the lower side). Moreover, a trend can be discerned whereby regardless of the ink viscosity (namely, the reference viscosity, higher viscosity than the reference viscosity (viscosity on the higher side), or lower viscosity than the reference viscosity (viscosity on the lower side)), the ink droplet discharge amount decreases the lower the drive frequency, and the ink droplet discharge amount increases the higher the drive frequency. Note that in the present embodiment, ink droplet discharge amounts peak at a particular frequency (for example 20 kHz), after which there is a decreasing trend in the ink droplet discharge amount with increasing drive frequency.

Moreover, as illustrated in the graph of FIG. 8, a trend can be discerned whereby regardless of whether the ink viscosity is on the higher side of the reference viscosity or on the lower side of the reference viscosity, the amount of divergence (namely, the absolute value of the difference from the ink droplet discharge amount at the reference viscosity) of the ink droplet discharge amount increases the higher the drive frequency. Moreover, a trend can be discerned whereby the amount of divergence of the ink droplet discharge amount is greater when the ink viscosity is on the lower side of the reference viscosity than when the ink viscosity is on the higher side of the reference viscosity. For example, the peak value of the divergence amount when the ink viscosity is on the lower side of the reference viscosity is approximately 13%, whereas the peak value of the divergence amount when the ink viscosity is on the higher side of the reference viscosity is approximately 7%. This is thought to be because residual vibration of the meniscus attenuates less readily the lower the ink viscosity, resulting in residual vibration exerting a greater influence on ink droplet ejection.

Since the ink droplet discharge amount (unit ejection amount) changes according to the ink viscosity, and the actual ink droplet discharge amount diverges from the reference viscosity design ink droplet discharge amount, the unit ejection amount obtained as described above is corrected based on the initial viscosity information acquired from the cartridge-side storage section 49. For example, correction coefficients corresponding to the initial viscosity information are pre-stored in a table in the body-side storage section 14, and a correction coefficient corresponding to the initial viscosity information is acquired from the table. The unit ejection amount is then corrected using the acquired correction coefficient. Detailed explanation follows regarding a correction method using such a correction coefficient table, with reference to the example of the correction coefficient table illustrated in FIG. 9. As illustrated in FIG. 9, the unit ejection amount is not corrected in cases in which the initial viscosity information is data indicating an initial viscosity the same as the reference viscosity or within the tolerance range ("reference" in the table of FIG. 9) (hereafter, initial viscosity information within the tolerance range is referred to as "reference viscosity" as appropriate), since the unit ejection amount corresponding to a single ink droplet is substantially the same as the unit ejection amount at the reference viscosity, namely, the unit ejection amount (design value) stored in the body-side storage section 14. Namely, at the reference viscosity, the correction coefficient is 0% regardless of the dot size formation mode, namely, regardless of the frequency mode.

In cases in which the initial viscosity information is data indicating a higher viscosity than the reference viscosity ("high" in the table of FIG. 9), the unit ejection amount corresponding to a single ink droplet will be less than the unit ejection amount stored in the body-side storage section 14. Accordingly, the unit ejection amount is corrected so as to decrease the unit ejection amount. In the example illustrated in FIG. 9, the correction coefficient is negative for each of the dot size formation modes. The correction coefficient corresponding to the formation mode of the selected dot size is selected from the correction coefficients corresponding to high viscosity in FIG. 9. For example, if the large dot formation mode is selected, a correction coefficient of −6% will be selected. If the medium-sized dot formation mode is selected, a correction coefficient of −4% will be selected. If the small dot formation mode is selected, a correction coefficient of −4% will be selected. The selected correction coefficient is multiplied by the unit ejection amount, and the value thus obtained is added to the unit ejection amount (in this case, since the correction coefficient is negative, the absolute value of the obtained value is subtracted from the unit ejection amount) in order to obtain a corrected unit ejection amount.

Note that as described above, since there is a trend for the amount of divergence of the ink droplet discharge amount (namely, the absolute value of the difference from the ink droplet discharge amount at the reference viscosity) to increase as drive frequency increases (see FIG. 8), it is desirable to set the table correspondingly, such that the absolute values of the correction coefficients become greater as the dot formation size increases. In other words, in cases in which the large dot formation mode (high frequency mode) is selected, it is desirable that the correction amount (namely, the absolute value of the correction coefficient) for the unit ejection amount be greater than in cases in which the small dot formation mode (low frequency mode) is selected. In the example illustrated in FIG. 9, for high viscosities, the absolute value of the correction coefficient used in the large dot formation mode is greater than the absolute values of the correction coefficients for the formation modes for a medium-sized dot or a small dot. Note that the absolute value of the correction coefficient used in the medium-sized dot formation mode is the same as the absolute value of the correction coefficient used in the small dot formation mode.

On the other hand, in cases in which the initial viscosity information is data indicating a lower viscosity than the reference viscosity ("low" in the table of FIG. 9), the unit ejection amount corresponding to a single ink droplet will be greater than the unit ejection amount stored in the body-side storage section 14. Accordingly, the unit ejection amount is corrected so as to increase the unit ejection amount. In the example illustrated in FIG. 9, the correction coefficient is positive for each of the formation modes for each dot size. The correction coefficient corresponding to the formation mode of the selected dot size is selected from the correction coefficients corresponding to low viscosity in FIG. 9. For example, if the large dot formation mode is selected, a correction coefficient of +9% will be selected. If the medium-sized dot formation mode is selected, a correction coefficient of +7% will be selected. If the small dot formation mode is selected, a correction coefficient of +6% will be selected. The selected correction coefficient is multiplied by the unit ejection amount, and the value thus obtained is added to the unit ejection amount in order to obtain a corrected unit ejection amount.

Note that similarly to in cases in which the initial viscosity information is a high viscosity, it is desirable to set the table such that the absolute values of the correction coefficients become greater as the dot formation size increases. In other words, in cases in which the large dot formation mode (high frequency mode) is selected, it is desirable that the correction amount (namely, the absolute value of the correction coefficient) for the unit ejection amount be greater than in cases in which the small dot formation mode (low frequency mode) is selected. In the example illustrated in FIG. 9, for low viscosities, the absolute value of the correction coefficient used in the large dot formation mode is greater than the absolute value of the correction coefficient used in the medium-sized dot formation mode, and the absolute value of the correction coefficient used in the medium-sized dot formation mode is greater than the absolute value of the correction coefficient used in the small dot formation mode.

Moreover, as described above, since there is a trend for the amount of divergence of the ink droplet discharge amount to be greater when the ink viscosity is on the lower side of the reference viscosity than when the ink viscosity is on the higher side of the reference viscosity (see FIG. 8), it is preferable to set the correction coefficients such that for the same dot size (drive frequency), the absolute values of the correction coefficients are greater when the ink viscosity is on the lower side of the reference viscosity than when the ink viscosity is on the higher side of the reference viscosity. In the example illustrated in FIG. 9, in each of the formation modes for a large dot, a medium-sized dot, or a small dot, the absolute values of the correction coefficients for low viscosity are greater than the absolute values of the correction coefficients for high viscosity. In short, in cases in which the initial viscosity information is information indicating a lower viscosity than the reference viscosity, it is desirable that the correction amount (in other words, the absolute value of the correction coefficient) for the unit ejection amount be greater than in cases in which the initial viscosity information is information indicating a higher viscosity than the reference viscosity.

As described above, the corrected unit ejection amount is stored in the body-side storage section 14. The control circuit 13 then computes a consumption amount of ink ejected from each nozzle 35 (ink consumption amount) based on the corrected unit ejection amount and the image information. Specifically, the ink consumption amount is computed by multiplying the corrected unit ejection amount by the number of ink droplet ejection times, obtained using the image information. The ink consumption amounts are stored in the body-side storage section 14 and totaled. The control circuit 13 then predicts the remaining ink amount inside the ink cartridge 10 based on the totaled value. The remaining ink amount is predicted in this manner for each ink cartridge 10. Moreover, the remaining ink amount in each ink cartridge 10 is, for example, displayed on the display device 27 or the like in response to user commands or the like. In addition, when the remaining ink amount of an ink cartridge 10 is running low, for example, the user is notified using the display device 27 or the like. Note that the remaining ink amount obtained may be stored in the cartridge-side storage section 49 of the corresponding ink cartridge 10.

In this manner, the unit ejection amount is corrected based on the initial viscosity information, and the ink consumption amount is derived based on the corrected unit ejection amount, thereby enabling a more accurate ink consumption amount to be obtained. The remaining ink amount inside each ink cartridge 10 can be more accurately ascertained as a result. Namely, the remaining ink amount can be more accurately computed due to correcting the unit ejection amount based on the initial viscosity information, and then predicting the remaining ink amount inside the ink cartridge 10 based on the corrected unit ejection amount. The configuration of the printer 1 is simplified since there is no need to provide a way of detecting the viscosity, such as a sensor. Moreover, in cases in which the initial viscosity information is information indicating a lower viscosity than the reference viscosity, the unit ejection amount correction amount is greater than in cases in which the initial viscosity information is information indicating a higher viscosity than the reference viscosity, thereby enabling even more accurate computation of the remaining ink amount. Moreover, the correction coefficient is also changed according to information relating to the dot size (namely, drive frequency). In other words, the unit ejection amount is corrected based on information relating to the dot size. This thereby enables even more accurate computation of the remaining ink amount. Namely, more accurate computation of the remaining ink amount is possible even in cases in which the drive frequency is changed according to the dot size. In cases in which a relatively high drive frequency mode (high frequency mode) is selected, the unit ejection amount correction amount is greater than in cases in which a relatively low drive frequency mode (low frequency mode) is selected, thereby enabling even more accurate computation of the remaining ink amount. Moreover, since the remaining ink amount is predicted for each ink cartridge 10, the remaining ink amount can be more accurately computed for each cartridge.

Note that in the embodiment described above, the unit ejection amount is derived according to the drive frequency (frequency mode), and the unit ejection amount is corrected based on the initial viscosity information acquired from the cartridge-side storage section 49. However, there is no limitation thereto. The unit ejection amount may be set to a uniform value regardless of the drive frequency, and an amount of divergence arising when the drive frequency is changed may be included in the correction coefficient for correcting the unit ejection amount. Explanation follows regarding a detection method for the remaining ink amount inside the ink cartridge 10 using such a correction coefficient, with reference to another example of a correction coefficient table, illustrated in FIG. 10.

First, the control circuit 13 acquires, from the body-side storage section 14, a unit ejection amount (design value) for a case in which ink viscosity is a predetermined reference viscosity and ink is ejected at a predetermined reference drive frequency (for example, a case in which the medium-sized dot formation mode (reference mode) is selected). The unit ejection amount is corrected based on the initial viscosity information acquired from the cartridge-side storage section 49. Namely, the correction coefficient corresponding to the initial viscosity information is acquired from the correction coefficient table illustrated in FIG. 10, and the ink consumption amount is computed using this correction coefficient and unit ejection amount.

For example, the correction coefficient is 0% in a case in which the drive frequency has the same value as the reference drive frequency (for example a case in which the reference mode is selected), and the initial viscosity information acquired from the cartridge-side storage section 49 is data indicating an initial viscosity the same as the reference viscosity or within the tolerance range (referred to hereafter as the "reference viscosity") (when both the initial viscosity and the drive frequency are "reference" in the table of FIG. 10). Namely, correction is not performed in such cases, since the unit ejection amount corresponding to a single ink droplet is substantially the same as the unit ejection amount at the reference drive frequency and the reference viscosity, namely, the unit ejection amount (design value) stored in the body-side storage section 14. On the other hand, in cases in which the initial viscosity information is data indicating the reference viscosity, and the drive frequency has a higher value than the reference drive frequency (for example, when the high frequency mode is selected), the unit ejection amount will be greater than the unit ejection amount (design value) stored in the body-side storage section 14. Accordingly, the unit ejection amount is corrected so as to become smaller. In the example illustrated in FIG. 10, in a case in which the initial viscosity is "reference" and the drive frequency is "high", a correction coefficient of +4% will be selected. Further, in cases in which the initial viscosity information is data indicating the reference viscosity, and the drive frequency has a lower value than the reference drive frequency (for example, when the low frequency mode is selected), the unit ejection amount will be smaller than the unit ejection amount (design value) stored in the body-side storage section 14. Accordingly, the unit ejection amount is corrected so as to become smaller. In the example illustrated in FIG. 10, in a case in which the initial viscosity is "reference" and the drive frequency is "low", a correction coefficient of −3% will be selected.

Moreover, in cases in which the initial viscosity information is data indicating a higher viscosity than the reference viscosity (a "high" initial viscosity in the table of FIG. 10), the unit ejection amount will be less than the unit ejection amount for the reference viscosity at the same drive frequency. Specifically, in a case in which the initial viscosity information is data indicating a higher viscosity than the reference viscosity and the drive frequency is the same value as the reference drive frequency, the unit ejection amount will be less than the unit ejection amount (design value) stored in the body-side storage section 14. Accordingly, the unit ejection amount is corrected so as to become smaller. In the example illustrated in FIG. 10, in a case in which the initial viscosity is "high" and the drive frequency is "reference", a correction coefficient of −4% will be selected. Further, for high viscosities, in cases in which the drive frequency is high, the correction coefficient is set to a greater value than in cases in which the drive frequency is "reference", and in cases in which the drive frequency is low, the correction coefficient is set to a smaller value than in cases in which the drive frequency is "reference". In the example illustrated in FIG. 10, in a case in which the initial viscosity is "high" and the drive frequency is "high", a correction coefficient of −2% will be selected. In a case in which the initial viscosity is "high" and the drive frequency is "low", a correction coefficient of −7% will be selected.

Moreover, in cases in which the initial viscosity information is data indicating a lower viscosity than the reference viscosity (a "low" initial viscosity in the table of FIG. 10), the unit ejection amount will be greater than the unit ejection amount for the reference viscosity at the same drive frequency. Specifically, in a case in which the initial viscosity information is data indicating a lower viscosity than the reference viscosity and the drive frequency is the same value as the reference drive frequency, the unit ejection amount will be greater than the unit ejection amount (design value) stored in the body-side storage section 14. Accordingly, the unit ejection amount is corrected so as to become greater. In the example illustrated in FIG. 10, in cases in which the initial viscosity is "low" and the drive frequency is "reference", a correction coefficient of +7% will be selected. Further, for low viscosities, in cases in which the drive frequency is high, the correction coefficient is set greater to a greater value than in cases in which the drive frequency is "reference", and in cases in which the drive frequency is low, the correction coefficient is set to a smaller value than in cases in which the drive frequency is "reference". In the example illustrated in FIG. 10, in a case in which the initial viscosity is "low" and the drive frequency is "high", a correction coefficient of +14% will be selected. In a case in which the initial viscosity is "low" and the drive frequency is "low", a correction coefficient of +2% will be selected.

The selected correction coefficient is then multiplied by the unit ejection amount, and the value thus obtained is added to the unit ejection amount (in cases in which the correction coefficient is a negative value, the absolute value of the correction coefficient is subtracted from the unit ejection amount) to correct the unit ejection amount. The control circuit 13 computes the ink consumption amount by multiplying the corrected unit ejection amount by the number of ink droplet ejection times obtained using the image information. The ink consumption amounts are stored in the body-side storage section 14 and totaled. The control circuit 13 then predicts the remaining ink amount inside the ink cartridge 10 based on the totaled value.

Note that as described above, since there is a trend for the amount of divergence (namely, the absolute value of the difference from the ink droplet discharge amount at the reference viscosity) of the ink droplet discharge amount (the unit ejection amount) to increase as drive frequency increases (see FIG. 8), in the remaining ink amount detection method of the present example it is desirable to set the table such that for the same initial viscosity, the absolute values of the correction coefficients become greater as drive frequency increases. In other words, for the same initial viscosity, in cases in which a relatively high drive frequency mode (high frequency mode) is selected, it is desirable that the correction amount for the unit ejection amount be greater than in cases in which a relatively low drive frequency mode (low frequency mode) is selected. In the example illustrated in FIG. 10, for the reference viscosity and for low viscosities, the amount of divergence of the correction coefficient used in cases in which the drive frequency is relatively high from the correction coefficient used with the reference drive frequency (the absolute value of the difference between the two correction coefficients) is greater than the amount of divergence of the correction coefficient in cases in which the drive frequency is relatively low from the correction coefficient used with the reference drive frequency.

Moreover, as described above, since there is a trend for the amount of divergence of the ink droplet discharge amount to become greater when the ink viscosity is on the lower side of the reference viscosity than when the ink viscosity is on the higher side of the reference viscosity (see FIG. 8), in the remaining ink amount detection method of the present example it is desirable to set the correction coefficients such that for the same drive frequency, the absolute values of the correction coefficients are greater when the ink viscosity is on the lower side of the reference viscosity than when the ink viscosity is on the higher side of the reference viscosity. Namely, for the same drive frequency, in cases in which the initial viscosity information is information indicating a lower viscosity than the reference viscosity, it is desirable to set the correction amount for the unit ejection amount (in other words, the absolute value of the difference from the correction coefficient used with the reference viscosity) so as to be greater than in cases in which the initial viscosity information is information indicating a higher viscosity than the reference viscosity. In the example illustrated in FIG. 10, in each of the respective modes for cases in which the drive frequency is relatively high, cases with the reference drive frequency, and cases in which the drive frequency is relatively low, the amount of divergence of the correction coefficient used when the initial viscosity is low from the correction coefficient used with the reference viscosity (the absolute value of the differences between the two correction coefficients) is greater than the amount of divergence of the correction coefficient used when the initial viscosity is high from the correction coefficient used with the reference viscosity.

In this manner, since the correction coefficients used to correct the unit ejection amount consider the amount of divergence when the drive frequency has been changed, the unit ejection amount prior to correction is a uniform value irrespective of the drive frequency, thus rendering a process to compute the unit ejection amount unnecessary. Computation of the ink consumption amount is simplified as a result. Moreover, in the correction coefficient table illustrated in FIG. 10, in cases in which the initial viscosity information is information indicating a lower viscosity than the reference viscosity, the unit ejection amount correction amount is greater than in cases in which the initial viscosity information is information indicating a higher viscosity than the reference viscosity, thereby enabling even more accurate computation of the remaining ink amount. Moreover, in cases in which a relatively high drive frequency mode (high frequency mode) is selected, the unit ejection amount correction amount is greater than in cases in which a relatively low drive frequency mode (low frequency mode) is selected, thus enabling yet more accurate computation of the remaining ink amount. Moreover, more accurate remaining ink amount computation is enabled even in cases in which the drive frequency is changed in accordance with dot size.

Note that in the embodiment described above, the unit ejection amount is corrected by referencing the correction coefficient table stored in the cartridge-side storage section 49 in order to acquire the correction coefficient corresponding to the drive frequency (dot size) and the initial viscosity. However, there is no limitation thereto. For example, a formula for deriving the unit ejection amount may be pre-stored in the body-side storage section, and the drive frequency (dot size) and the initial viscosity information may be applied to this formula in order to derive the unit ejection amount. In addition, the correction coefficient table in the example described above is a 3×3 table in which drive frequency (dot size) and initial viscosity are each classified into three categories (ranges). However, there is no limitation thereto. A correction coefficient table may be provided in which the drive frequency (dot size) and initial viscosity are each classified into smaller categories.

Moreover, in the embodiment described above, the remaining ink amount prediction is performed for each ink cartridge 10. However, there is no limitation thereto. It is desirable that remaining ink amount prediction be performed for at least the ink cartridge holding black (K) ink (the black ink cartridge). This enables more accurate computation of the remaining ink amount (remaining black ink amount) for at least the ink cartridge corresponding to black (K) ink, which is consumed at the fastest rate. Moreover, in cases in which plural ink cartridges have differing ink holding capacities, it is desirable that remaining ink amount prediction be performed for at least the ink cartridge with the largest capacity (highest capacity cartridge). This thereby enables more accurate remaining ink amount computation for at least the ink cartridge with the largest capacity.

Moreover, since ink viscosity changes with temperature, namely, since the unit ejection amount also changes depending on the temperature of the ink inside the recording head 2, configuration may be made in which the ink consumption amount is also corrected for temperature. For example, a temperature measuring unit may be provided inside the recording head 2, and the unit ejection amount corrected based on the initial viscosity information may be further corrected based on a temperature measured by the temperature measuring unit. For example, a method in which a correction coefficient table such as in the examples illustrated in FIG. 9 and FIG. 10 is provided for each temperature, and the correction coefficient table corresponding to the measured temperature is selected in order to correct the initial viscosity information, may be adopted as such a correction method. Alternatively, for example, a method may be adopted in which the correction coefficients in a correction coefficient table such as in the examples illustrated in FIG. 9 and FIG. 10 are further corrected for temperature, or a method may be adopted in which a formula for deriving the unit ejection amount is pre-stored in the cartridge-side storage section, and the drive frequency (dot size), initial viscosity information, and temperature information are applied to the formula in order to derive the unit ejection amount. In addition, it is sufficient that the unit ejection amount be corrected based on at least the initial viscosity information, although other parameters that relate to the unit ejection amount may also be employed to correct the unit ejection amount. In such cases, correction based on the other parameters may be performed together with and at the same time as the correction based on the initial viscosity information, or correction based on the other parameters may be performed separately to the correction based on the initial viscosity information. In essence, the scope of rights of the invention includes any configuration in which the remaining ink amount is computed based on at least the initial viscosity information.

In the foregoing explanation, the ink jet recording apparatus 1 is given as an example of a liquid ejecting apparatus. However, the invention may also be applied to other liquid ejecting apparatuses. For example, the invention can be applied to a liquid ejecting apparatus provided with colorant ejecting head employed in the manufacture of color filters for liquid crystal displays or the like; a liquid ejecting apparatus provided with an electrode material ejecting head employed to form electrodes of organic electroluminescence (EL) displays, field emission displays (FEDs), or the like; a liquid ejecting apparatus provided with bioorganic matter ejecting heads employed in the manufacture of biochips (biochemical elements); and the like. In colorant ejecting heads for display manufacturing apparatuses, solutions of R (red), G (green), and B (blue) colorants are each ejected as a type of liquid. In electrode material ejecting heads for electrode forming apparatuses, a liquid electrode material is ejected as one type of liquid, and in bioorganic matter ejecting heads for chip manufacturing apparatuses, a bioorganic matter solution is ejected as one type of liquid.

The entire disclosure of Japanese Patent Application No. 2016-177364, filed Sep. 12, 2016 is expressly incorporated by reference herein.

What is claimed is:

1. A liquid ejecting apparatus is supplied a first liquid from a first cartridge having a first storage section storing a first liquid information including a first initial viscosity information relating of the first liquid held in the first cartridge, the liquid ejecting apparatus comprising:

a liquid ejecting head that includes first nozzles for ejecting the first liquid supplied from the first cartridge toward a landing target;

a control circuit configured to control ejection of the first liquid by the liquid ejecting head based on image information for an image to be formed on the landing target, and the control circuit configured to compute a first remaining liquid amount inside the first cartridge; and a body side storage section configured to store a first reference unit ejection amount corresponding to a single droplet of the first liquid ejected from the first nozzles in a case in which a viscosity of the first liquid is a first predetermined reference viscosity, wherein the control circuit is configured to achieve a first corrected unit ejection amount that corrected the first reference unit ejection amount based on the first initial viscosity information acquired from the first storage section of the first cartridge, compute a consumption amount of the first liquid that has been ejected from the first nozzles based on the first corrected unit ejection amount and the image information, and compute a remaining liquid amount inside the first cartridge based on the consumption amount of the first liquid.

2. The liquid ejecting apparatus according to claim 1, wherein:

a correction amount from the first reference unit ejection amount to the first corrected unit ejection amount in cases in which the first initial viscosity information is information indicating a lower viscosity than the first predetermined reference viscosity by a given amount is greater than a correction amount from the first reference unit ejection amount to the first corrected unit ejection amount in cases in which the first initial viscosity information is information indicating a higher viscosity than the first predetermined reference viscosity by the given amount.

3. The liquid ejecting apparatus according to claim 1, wherein:

the image information includes information relating to the size of a dot to be formed on the landing target; and the control circuit is configured to achieve the first corrected unit ejection amount by correcting the first reference unit ejection amount based on the information relating to the size of the dot and the first initial viscosity information.

4. The liquid ejecting apparatus according to claim 1, wherein:

the liquid ejecting apparatus operates in a high frequency mode in which an ejection frequency of the first liquid ejected from the first nozzle is relatively high and a low frequency mode in which an ejection frequency of the first liquid ejected from the first nozzle is relatively low; and a correction amount from the first reference unit ejection amount to the first corrected unit ejection amount in cases in which the high frequency mode has been selected is greater than a correction amount from the first reference unit ejection amount to the first corrected unit ejection amount in cases in which the low frequency mode has been selected.

5. The liquid ejecting apparatus according to claim 1, wherein:

the liquid ejecting apparatus is supplied a second liquid from a second cartridge having a second storage section storing a second liquid information including a second initial viscosity information relating of the second liquid held in the second cartridge, the second liquid is a different type of liquid from the first liquid;

the liquid ejecting head includes second nozzles for ejecting the second liquid supplied from the second cartridge toward the landing target;

the control circuit is configured to control ejection of the second liquid by the liquid ejecting head based on the image information for the image to be formed on the landing target, and the control circuit is configured to compute a second remaining liquid amount inside the second cartridge;

the body side storage section is configured to store a second reference unit ejection amount corresponding to a single droplet of the second liquid ejected from the second nozzles in a case in which a viscosity of the second liquid is a second predetermined reference viscosity; and the control circuit is configured to achieve a second corrected unit ejection amount that corrected the second reference unit ejection amount based on the second initial viscosity information acquired from the second storage section of the second cartridge, compute a consumption amount of the second liquid that has been ejected from the second nozzles based on the second corrected unit ejection amount and the image information, and compute a remaining liquid amount inside the second cartridge based on the consumption amount of the second liquid.

6. The liquid ejecting apparatus according to claim 1, wherein:

the first liquid is black liquid.

7. The liquid ejecting apparatus according to claim 1, wherein:

the liquid ejecting apparatus is supplied a second liquid from a second cartridge, a capacity of a ink chamber holding the first liquid of the first cartridge is larger than a capacity of a ink chamber holding the second liquid of the second cartridge;

and the control circuit is configured to compute at least the remaining liquid amount inside the first cartridge.

8. The liquid ejecting apparatus according to claim 1, wherein:

when a viscosity indicated by the first initial viscosity information is lower than the first predetermined reference viscosity, the first corrected unit ejection amount is larger than the first reference unit ejection amount, and when a viscosity indicated by the first initial viscosity information is higher than the first predetermined reference viscosity, the first corrected unit ejection amount is smaller than the first reference unit ejection amount.

* * * * *